US010724330B2

(12) United States Patent
McEvoy et al.

(10) Patent No.: US 10,724,330 B2
(45) Date of Patent: Jul. 28, 2020

(54) VALVE OPERATION AND RAPID CONVERSION SYSTEM AND METHOD

(71) Applicant: GE Oil & Gas Pressure Control LP, Houston, TX (US)

(72) Inventors: Travis Kyle McEvoy, Houston, TX (US); Lloyd Cheatham, Lake Jackson, TX (US); Keith Adams, Houston, TX (US); Jonathan Powell, Houston, TX (US); Timothy Fuller, Houston, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 169 days.

(21) Appl. No.: 15/970,014

(22) Filed: May 3, 2018

(65) Prior Publication Data

US 2018/0320476 A1 Nov. 8, 2018

Related U.S. Application Data

(60) Provisional application No. 62/500,851, filed on May 3, 2017.

(51) Int. Cl.

| | |
|---|---|
| ***E21B 34/02*** | (2006.01) |
| ***E21B 43/26*** | (2006.01) |
| ***E21B 33/068*** | (2006.01) |

(52) U.S. Cl.

CPC ..... *E21B 34/02* (2013.01); *E21B 33/068* (2013.01); *E21B 43/26* (2013.01)

(58) Field of Classification Search

CPC ..... E21B 43/26; E21B 34/02; E21B 33/068

See application file for complete search history.

(56) References Cited

U.S. PATENT DOCUMENTS

| | | | | |
|---|---|---|---|---|
| 4,230,299 | A * | 10/1980 | Pierce, Jr. | E21B 34/02 137/315.28 |
| 8,839,867 | B2 * | 9/2014 | Conrad | E21B 43/26 166/308.1 |
| 9,212,758 | B2 | 12/2015 | Adams et al. | |
| 9,708,886 | B2 * | 7/2017 | Frenzel | E21B 34/02 |
| 9,759,240 | B2 | 9/2017 | McEvoy et al. | |
| 9,903,190 | B2 * | 2/2018 | Conrad | E21B 43/26 |
| 10,233,721 | B2 * | 3/2019 | Hoang | F16K 3/316 |
| 10,364,645 | B2 * | 7/2019 | McKeon | F16K 43/00 |
| 10,378,309 | B2 * | 8/2019 | Elliott | F16K 3/30 |

(Continued)

*Primary Examiner* — Jennifer H Gay

(74) *Attorney, Agent, or Firm* — Hogan Lovells US LLP

(57) ABSTRACT

Embodiments of the present disclosure include a method of replacing valve operation methods during fracturing operations including installing a first operator on a first valve of a first fracturing tree. The method also includes installing a second operator on a second valve of a second fracturing tree, the second fracturing tree being adjacent the first fracturing tree. The method also includes removing the first operator from the first valve, the first valve maintaining a position on the first fracturing tree after the first operator is removed. The method further includes removing the second operator from the second valve, the second valve maintaining a position on the second fracturing tree after the second operator is removed. The method also includes installing the first operator on the second valve after the first operator is removed from the first valve and after the second operator is removed from the second valve.

20 Claims, 8 Drawing Sheets

(56) References Cited

U.S. PATENT DOCUMENTS 10,385,662 B2 * 8/2019 Conrad ..... E21B 34/14
10,392,914 B2 * 8/2019 Kajaria ..... F16L 55/07
10,494,898 B2 * 12/2019 Kajaria ..... E21B 17/02
2004/0216888 A1 * 11/2004 Schmidt ..... F16K 31/05
166/377
2007/0175640 A1 * 8/2007 Atencio ..... E21B 43/00
166/369
2012/0181013 A1 * 7/2012 Kajaria ..... E21B 43/26
166/79.1
2012/0181015 A1 * 7/2012 Kajaria ..... E21B 43/26
166/177.5
2013/0175038 A1 * 7/2013 Conrad ..... E21B 43/26
166/308.1
2013/0284455 A1 * 10/2013 Kajaria ..... E21B 43/26
166/379
2014/0020909 A1 * 1/2014 McKeon ..... E21B 34/02
166/379
2014/0262333 A1 * 9/2014 Frenzel ..... E21B 34/02
166/378
2016/0115773 A1 * 4/2016 Conrad ..... E21B 43/26
166/308.1
2016/0123109 A1 * 5/2016 Hoang ..... F16K 3/316
166/90.1
2016/0186526 A1 * 6/2016 Elliott ..... F16K 1/32
166/377
2017/0130555 A1 * 5/2017 Kajaria ..... E21B 34/02
2017/0275980 A1 * 9/2017 Kajaria ..... E21B 33/068
2017/0370172 A1 * 12/2017 Tran ..... E21B 33/038
2018/0073308 A1 * 3/2018 Tran ..... E21B 33/068
2018/0163501 A1 * 6/2018 Guidry ..... E21B 33/062
2018/0291718 A1 * 10/2018 Conrad ..... E21B 43/26
2018/0298735 A1 * 10/2018 Conrad ..... E21B 43/26
2018/0320476 A1 * 11/2018 McEvoy ..... E21B 34/02
2019/0107222 A1 * 4/2019 Klyashitsky ..... F16K 31/163
2019/0368308 A1 * 12/2019 Elliott ..... F16K 3/30

* cited by examiner

VALVE OPERATION AND RAPID CONVERSION SYSTEM AND METHOD

CROSS REFERENCE TO RELATED APPLICATION

This application claims priority to and the benefit of: U.S. Provisional Application Ser. No. 62/500,851 filed May 3, 2017, titled "Valve Operation and Rapid Conversion System and Method," the full disclosure of which is hereby incorporated herein by reference in its entirety for all purposes.

BACKGROUND

1. Field of Invention

This disclosure relates in general to valve assemblies, and in particular, to systems and methods for conversions between manual and actuated valves.

2. Description of the Prior Art

In oil and gas production, various tubulars, valves, and instrumentation systems may be used to direct fluids into and out of a wellhead. For example, in hydraulic fracturing operations, frac trees may be arranged at the wellhead and include pipe spools and various valves to direct hydraulic fracturing fluid into the wellbore. These valves may be actuated valves, which are significantly more expensive than manually operated valves. If several trees are arranged proximate one another, fracturing may be done in series, with one frac tree being utilized before a second frac tree is used. As a result, significant expense is expended on hydraulic systems and actuated valves that are not in use during large portions of fracturing operations.

SUMMARY

Applicants recognized the problems noted above herein and conceived and developed embodiments of systems and methods, according to the present disclosure, for fracturing operations.

In an embodiment a method for conducting hydraulic fracturing operations includes positioning a plurality of fracturing trees at well site, the well site associated with hydraulic fracturing operations. The method also includes including a first valve on a first fracturing tree of the plurality of fracturing trees, the first valve being coupled to an actuator to control operation of the first valve and operated remotely by an operator that is not within a predetermined proximity of the first fracturing tree. The method further includes performing hydraulic fracturing operations through the first tree. The method also includes removing the actuator from the first valve after fracturing operations through the first tree are complete. The method includes installing the actuator on a second valve on a second fracturing tree of the plurality of trees. The method also includes performing hydraulic fracturing operations through the second tree.

In another embodiment a method of replacing valve operation methods during fracturing operations includes installing a first operator on a first valve of a first fracturing tree, the first operator being an actuator that controls operation of the first valve. The method also includes installing a second operator on a second valve of a second fracturing tree, the second fracturing tree being adjacent the first fracturing tree, and the second operator being a manual operator that is controlled by physical control with the manual operator. The method further includes performing hydraulic fracturing operations using the first fracturing tree. The method includes completing hydraulic fracturing operations using the first fracturing tree. The method also includes removing the first operator from the first valve, the first valve maintaining a position on the first fracturing tree after the first operator is removed. The method further includes removing the second operator from the second valve, the second valve maintaining a position on the second fracturing tree after the second operator is removed. The method also includes installing the first operator on the second valve after the first operator is removed from the first valve and after the second operator is removed from the second valve.

In an embodiment a method for performing hydraulic fracturing operations includes positioning a first fracturing tree at a well site, the first fracturing tree including a first valve controlling a first flow through the first fracturing tree. The method also includes positioning a second fracturing tree at the well site, the second fracturing tree including a second valve controlling a second flow through the second fracturing tree, the second fracturing tree being positioned adjacent the first fracturing tree such that access to the second fracturing tree is restricted while the first fracturing tree is in use. The method further includes performing hydraulic fracturing operations through the first fracturing tree. The method also includes removing a first operator from the first valve, the first valve maintaining a position on the first fracturing tree after the first operator is removed, and the first operator being an actuator. The method includes removing a second operator from the second valve, the second valve maintaining a position on the second fracturing tree after the second operator is removed, and the second operator being a manual operator. The method further includes installing the first operator on the second valve after the first operator is removed from the first valve and after the second operator is removed from the second valve. The method also includes performing hydraulic fracturing operations through the second fracturing tree.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
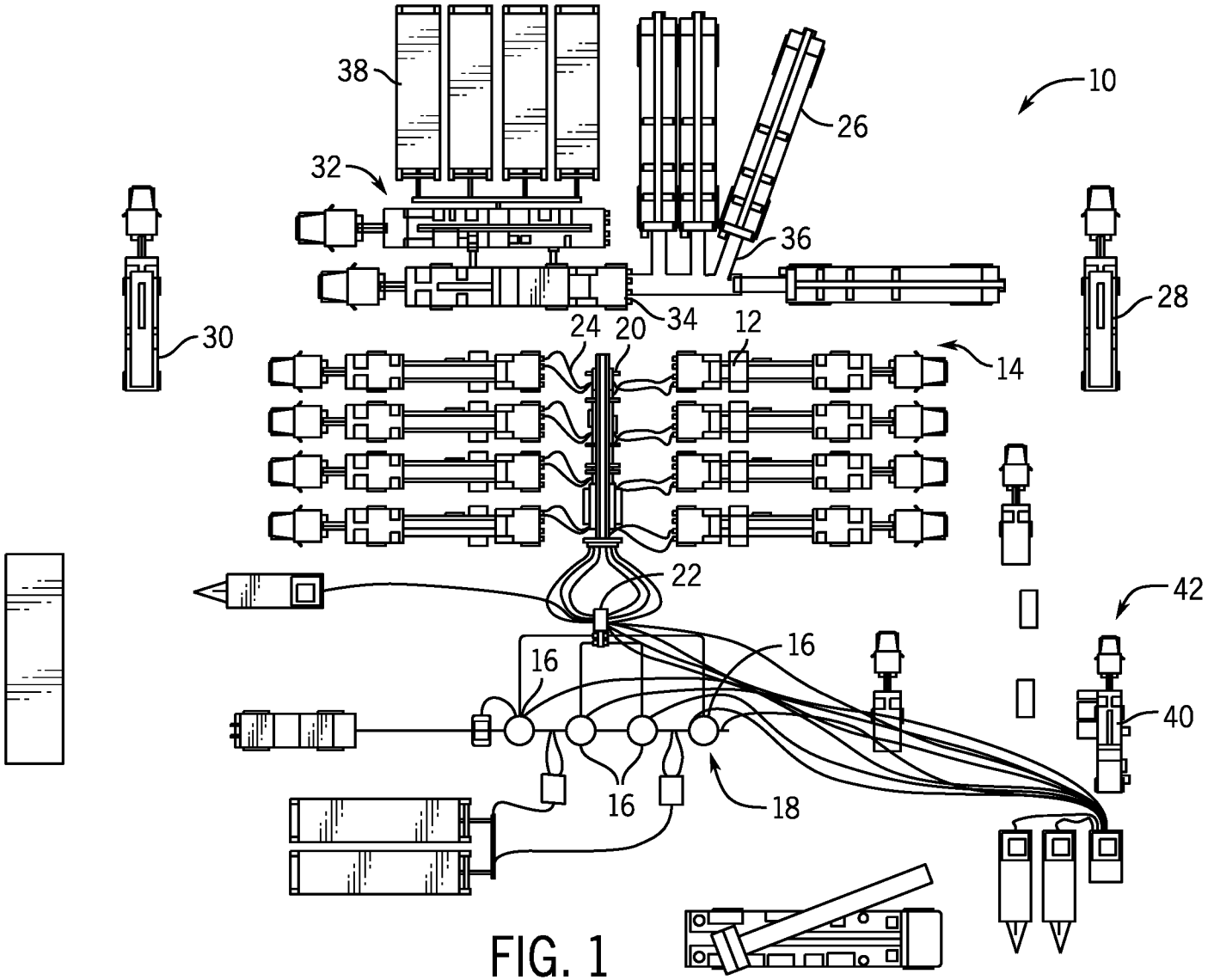
FIG. 1 is a schematic environmental view of an embodiment of a hydraulic fracturing operation, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure include systems and methods for converting actuated values into manually operated valves and for utilizing such a conversion at a fracturing site to increase asset utilization while reducing non-productive time of value added systems. In various embodiments, a valve converter is utilized to convert an actuated valve (e.g., hydraulic, pneumatic, etc.) to a manual valve (e.g., hand wheel). The valve converter may include a rotary to linear converter and/or a bearing system to translate rotational movement of a hand wheel into linear movement to drive a valve stem between an open position and a closed position. In various embodiments, the conversion on the valves may be utilized during fracturing operations. For example, in various embodiments, fracturing trees may be arranged proximate one another. During operations, a single tree may be in use while the others are not. That is, there may be a predetermined distance where operators may not enter during ongoing fracturing operations. The in use tree may utilize the actuated valves to enable fast and efficient opening/closing during fracturing operations. The actuated valves may be considered remotely operated, in that physical contact between an operator and the valves is not used to control operation of the valve. After operations are complete, the actuators for driving the valves may be moved to different trees and different valves, thereby reducing the cost associated with fracturing operations. That is, the actuators and accompanying valves may be considered high value assets due to their cost and efficiency. Reducing their non-productive time, for example by not including actuated valves on trees that are not in use, may reduce costs for operators. Accordingly, systems and methods of the present embodiment may be utilized to use actuators and actuated valves on in-use trees while converting out of use trees into manually operated valves.

FIG. 1 is a schematic environmental view of an embodiment of a hydraulic fracturing operation 10. In the illustrated embodiment, a plurality of pumps 12 are mounted to vehicles 14, such as trailers, for directing fracturing fluid into trees 16 that are attached to wellheads 18 via a missile 20. The missile 18 receives the fluid from the pumps 12 at an inlet head 22, in the illustrated embodiment. As illustrated, the pumps 12 are arranged close enough to the missile 20 to enable connection of fracturing fluid lines 24 between the pumps 12 and the missile 20.

FIG. 1 also shows equipment for transporting and combining the components of the hydraulic fracturing fluid or slurry used in the system of the present technology. However, for clarity, the associated equipment will not be discussed in detail. The illustrated embodiment includes sand transporting containers 26, an acid transporting vehicle 28, vehicles for transporting other chemicals 30, and a vehicle carrying a hydration unit 32. Also shown is a fracturing fluid blender 34, which can be configured to mix and blend the components of the hydraulic fracturing fluid, and to supply the hydraulic fracturing fluid to the pumps 12. In the case of liquid components, such as water, acids, and at least some chemicals, the components can be supplied to the blender 34 via fluid lines (not shown) from the respective components vehicles, or from the hydration unit 32. In the case of solid components, such as sand, the components can be delivered to the blender 34 by conveyors 36. The water can be supplied to the hydration unit 32 from, for example, water tanks 38 onsite. Alternately, water can be provided directly from the water tanks 38 to the blender 34, without first passing through the hydration unit 32.

In various embodiments, monitoring equipment 40 can be mounted on a control vehicle 42, and connected to, e.g., the pumps 12, blender 34, the trees 16, and other downhole sensors and tools (not shown) to provide information to an operator, and to allow the operator to control different parameters of the fracturing operation.

Figure 2:
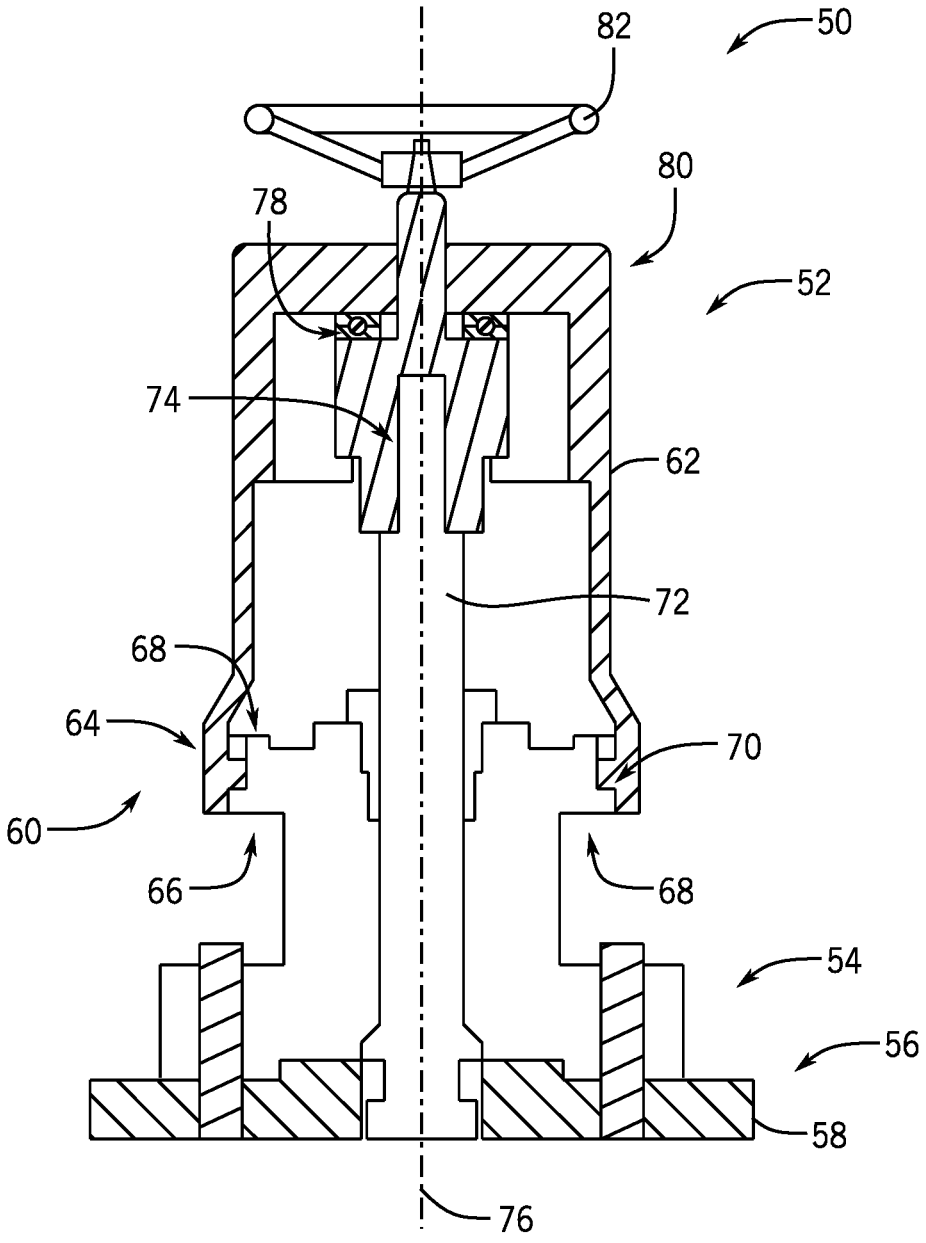
FIG. 2 is a schematic cross-sectional side view of an embodiment of a valve including a removable operator, in accordance with embodiments of the present disclosure.

FIG. 2 is a schematic cross-sectional elevational view of an embodiment of a valve 50 including a removable operator 52. Certain features of the removable operator may be described in U.S. Pat. No. 9,212,758 and U.S. patent application Ser. No. 14/949,324, both of which are incorporated herein by reference and owned by the Assignee of the instant application. Accordingly certain details of the removable operator may be omitted for clarity and conciseness. The illustrated removable operator 52 is coupled to a bonnet assembly 54 of the valve 50. The bonnet assembly 54 includes a lower end 56 coupled to a valve body 58 and an upper end 60. The removable operator 52 couples to the upper end 60 of the bonnet assembly 54, as shown in FIG. 2.

The illustrated removable operator 52 includes an operator housing 62 having lugs 64 extending radially inward. The upper end 60 of the bonnet assembly 54 includes a flange 66 that includes lugs 68 having grooves positioned therebetween. In operator, the lugs 64 may be lowered through the grooves and into a cavity 70. Once in the cavity 70, the operator housing 62 may be rotated to at least partially align with the lugs 68 of the flange 66. The alignment of the lugs 64, 68 blocks axial movement of the operator housing 62.

As shown in FIG. 2, a valve stem 72 extends through the operator housing 62 and the bonnet assembly 54 and into the valve body 58. The valve stem 72 may include a gate or other fluid blocking feature on a far end, which is not illustrated for clarity. The illustrated valve stem 72 is coupled to a rotary to linear converter 74. As will be described below, the rotary to linear converter 74 is configured to transform rotatory movement, for example via a hand wheel, to linear movement, which will drive the valve stem 72 axially along an axis 76. Movement of the valve stem 72 transitions the valve (e.g., a gate of the valve) between an open position, in which fluid may flow through the valve, to a closed position, in which fluid is blocked from flowing through the valve. The rotary to linear converter 74, at least in part, enables the valve 50 to be converted into a manually operated valve from a previously actuated valve (e.g., a valve that includes an actuator driven by some non-manual operator, such as a hydraulic or pneumatic fluid, among other options).

In various embodiments, an actuated valve may drive axial movement of the valve stem 72 along the axis 76. That is, the main driver may move with the valve stem 72. In contrast, a manually operated valve, for example via a hand wheel, will apply a rotational force that moves the valve stem 72 along the axis 76. In other words, the main driver is linearly stationary relative to the valve stem 72. The illustrated rotary to linear converter 74 enables the rotational movement of from the manual operator to be applied to the valve stem 72 without modifying the valve stem 72. For example, the rotary to linear converter 74 may be a jack screw, worm gear, ball screw, or the like that facilitates conversion of a rotary movement to a linear movement. Furthermore, the illustrated rotary to linear converter 74 may include a self-locking feature. As a result, constant pressure/rotational force to the hand wheel will not be necessary to maintain the position of the valve stem 72.

The embodiment illustrated in FIG. 2 further includes a bearing assembly 78 arranged between a top 80 and the rotary to linear converter 74. The bearing assembly 78 enables rotation of the rotary to linear converter 74 to drive the valve stem 72 between the open position and the closed position. It should be appreciated that, in various embodiments, the bearing assembly 78 may be located within a body portion of the operator housing 62, below the rotary to linear converter 74, or in any other reasonable position.

In various embodiments, the manual operator is a hand wheel 82, which may be affixed to an end of the rotary to linear converter 74. The hand wheel 82 may be pre-coupled to the operator housing 62 such that the system as a whole may be installed. For example, the removable operator 52 may include a variety of components and be removable such that the valve stem 72 remains coupled to the bonnet assembly 54. Additionally, the removable operator 52 associated with an actuator, such as a hydraulic actuator, may also be available. As a result, the two removable operators 52 may be swapped out without making other modifications to the valve 50, such as reworking or adjusting the valve stem 72. In this manner, the actuator may be moved to frac trees that are in operation, allowing cheaper manually operated valves to be used on trees that are not currently in operation.

In various embodiments, other components may be incorporated into the removable operator 52 to facilitate connections and switching. For instance, various couplings to enable connections to secondary systems may be included. Furthermore, valves typically have the nomenclature that a clockwise turn will bring the valve toward a closed position and a counter-clockwise turn will bring the valve toward an opened position. However, actuated valves typically have a reverse action gate, while manual valves have a direct gate. Accordingly, in certain embodiments, the rotatory to linear converter may include a left-handed thread to enable clockwise movement to drive the valve to the closed position. As a result, the status quo will be maintained and the likelihood of confusion for operators in the field is reduced. In this manner, actuated valves may be quickly and efficiently converted to manual valves.

Figure 3:
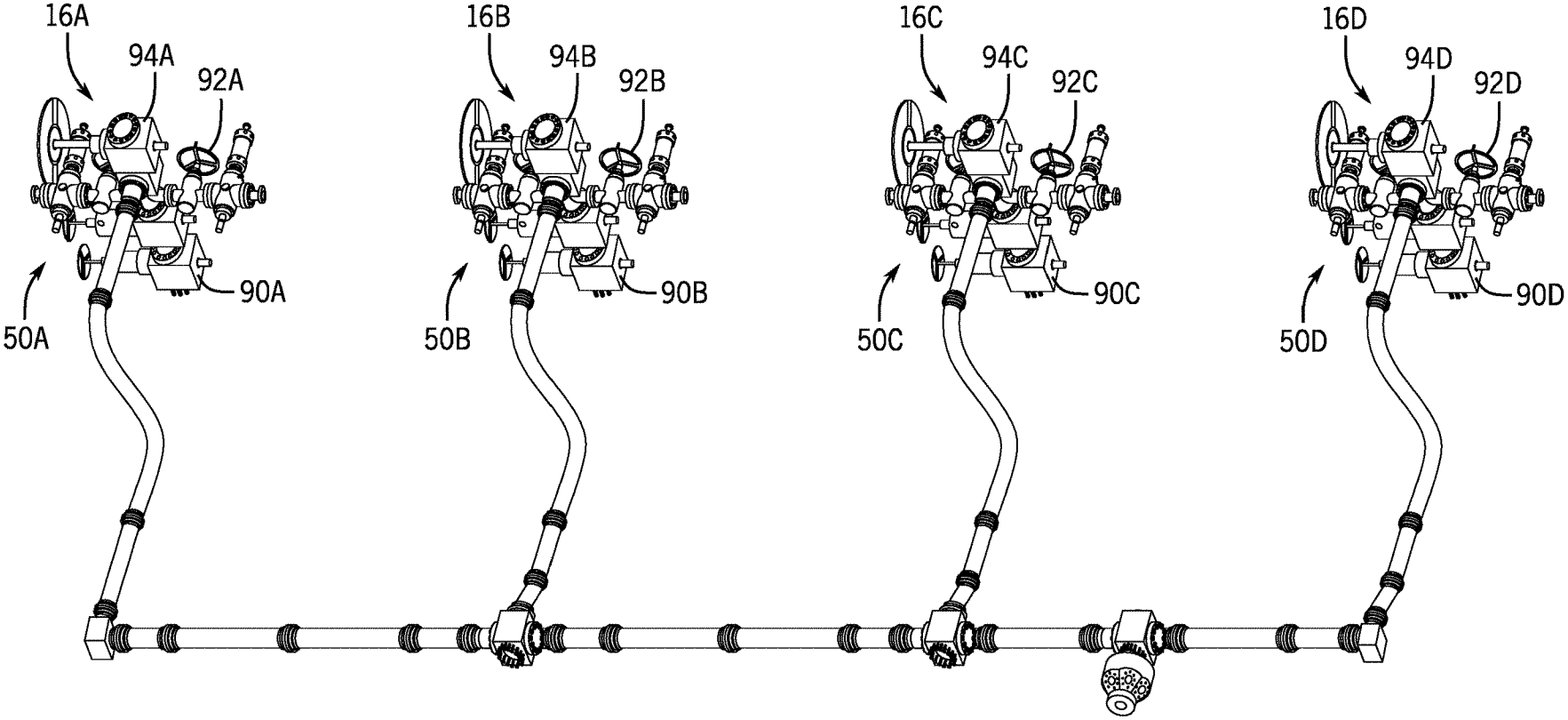
FIG. 3 is a schematic perspective view of an embodiment of fracturing trees at a fracturing site, in accordance with embodiments of the present disclosure.

As described above, and by way of example only, in hydraulic fracturing operations, operators may perform operations on multiple trees in different stages. If each tree includes a number of actuators for controlling the valves, costs may increase exponentially. Moreover, each tree may not be in operation at the same time, thereby creating a redundancy. The following example will be illustrated on a four stage fracturing operation using four trees. It should be appreciated that any number of stages and trees may be utilized with embodiments of the present disclosure. FIG. 3 is a schematic perspective view of an embodiment of a fracturing operation including four trees 16, each tree having a plurality of associated valves. The fracturing operation illustrated in FIG. 3 may be used in so called "zipper" fracturing operations, in which numerous trees 16 are arranged in relatively close proximity. During operations, hydraulic fracturing is performed on a well using a first tree, while the remaining trees are not in operation. As operations with the first tree complete, then operations on the second tree may begin, and so on.

The illustrated embodiment includes trees 16A-16D. Each tree 16 is associated with a respective wellhead (not pictured) and includes a lower master valve 90A-D, wing valves 92A-D, swab valves 94A-D, and other valves 50A-D. It should be appreciated that the systems and methods described herein may be utilized with any of the valves associated with the respective trees 16. As described above, the trees 16 receive hydraulic fracturing fluid, for example from the missile 20, which is directed into the well via the trees 16. The valves associated with the trees 16 may be utilized to block or restrict flow into the well. It should be appreciated that other components are illustrated in FIG. 3, but their description has been omitted for clarity.

Figure 4:
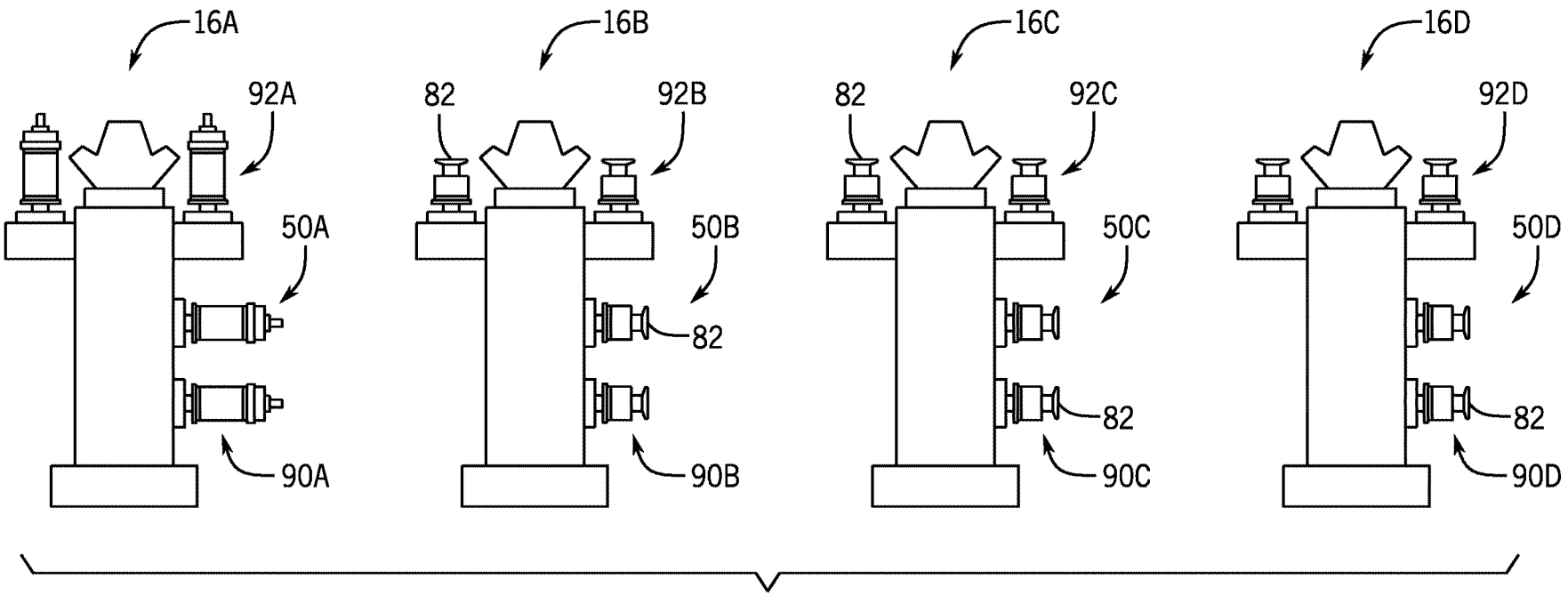
FIG. 4 is a schematic side view of an embodiment of a fracturing operation including four trees, in accordance with embodiments of the present disclosure.

FIG. 4 is a schematic diagram of an embodiment of a fracturing operation including the trees 16A-D. It should be appreciated that various features have been removed for clarity with the discussion herein. In the illustrated embodiment, each tree 16A-D includes a plurality of valves 50. The valves may include the lower master valve 90A-D, the wing valves 92A-D, and the swab valves 94A-D. The embodiment illustrated in FIG. 4 may be referred to as stage one of a four stage fracturing operation. During operations, each of the trees 16A-D will have periods of activity and periods of inactivity. That is, while fracturing operations are utilizing tree 16A, the trees 16B-D will not be used for fracturing operations. In illustrated stage one, tree 16A is being used for fracturing operations, and as a result, the valves 50 (e.g., lower master valve 90A, wing valve 92A, and swab valves 94A) include actuated valves. It should be appreciated that the actuated valves may be hydraulically actuated, pneumatically actuated, electrically actuated, or the like. In contrast, the valves 50 associated with the trees 16B-D may be manually operated valves, as illustrated by the presence of the hand wheels 82. It should be appreciated that the hand wheels 82 are for illustrative purposes only. Accordingly, the arrangement shown in FIG. 4 may reduce costs, compared to an arrangement where each valve for each tree 16A-D included the actuated valves.

Figure 5:
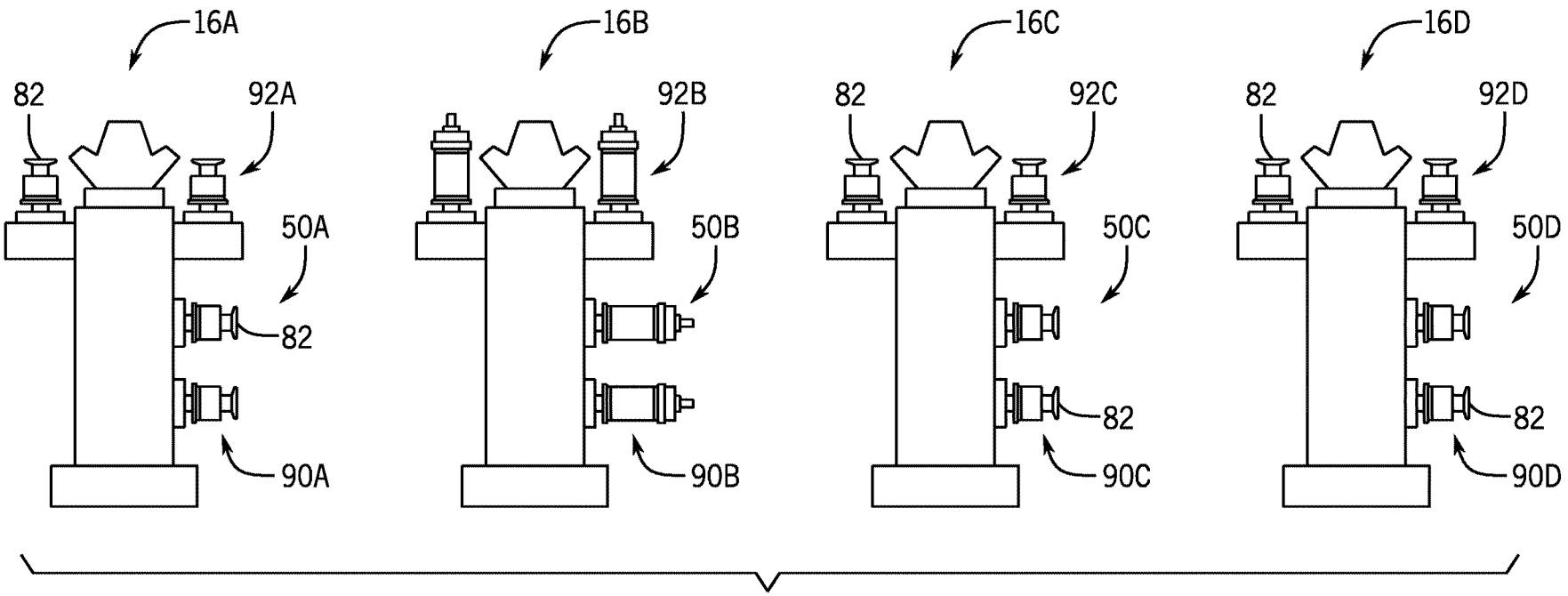
FIG. 5 is a schematic side view of an embodiment of a fracturing operation including four trees, in accordance with embodiments of the present disclosure.

FIG. 5 is a schematic diagram of the trees 16A-D during stage two of a fracturing operation. In the illustrated embodiment, the tree 16B includes actuated valves 50 while the remaining trees 16A, 16C, and 16D include manually operated valves. As described above, in various embodiments, the removable operators 52 may be quickly removed from the respective valves 50 such that the valve stem 72 remains with its associated valve. Advantageously, each valve does not need to be switched, but rather the valves of the tree 16 to undergo operations and just one of the remaining trees 16 that will not undergo operations. As a result, the operation takes less time. Furthermore, it should be appreciated that secondary value added systems, such as hydraulic tanks and pumps for operating the actuated valves, may quickly be coupled to the removable operator 52 as it is moved from tree to tree using flexible tubing and the like.

While embodiments of the present disclosure describing using the removable operators 52 for modifying the operation of the valves, in other embodiments, different methods or configurations may be utilized to swap out the actuated and manual operators. For example, the trees may include a double block system where each tree 16 includes a set of manual block valves and the actuated valves are moved from tree 16 to tree 16 by clearing and blocking in the manual block valves between the actuated block valves and the tree. As illustrated in FIG. 5, the same actuators from FIG. 4 may be utilized, thereby decreasing the cost of operations at the well site. As a result, the high value asset that is the actuator can be reused over various pieces of equipment, thereby decreasing non-productive time. Furthermore, the non-productive time of the associated equipment, such as hydraulic totes and pumps, may also be reduced.

Figure 6:
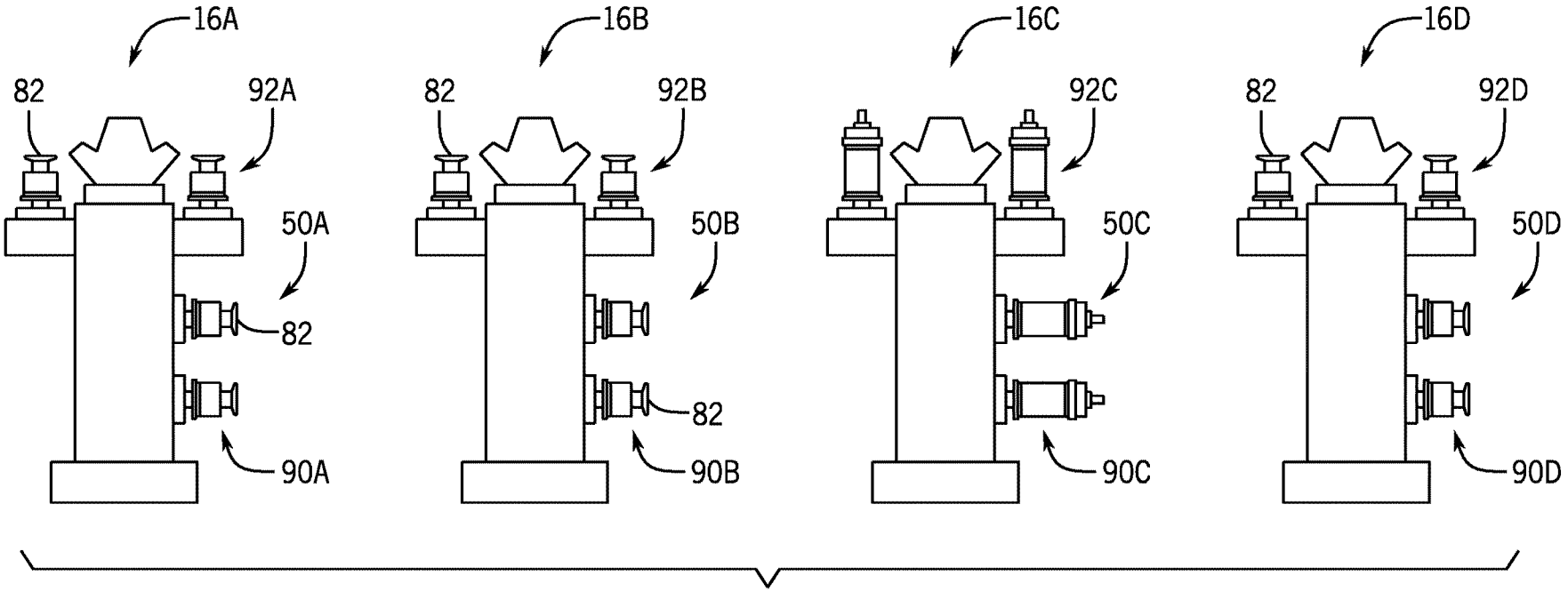
FIG. 6 is a schematic side view of an embodiment of a fracturing operation including four trees, in accordance with embodiments of the present disclosure.

FIG. 6 is a schematic diagram of the trees 16A-D during stage three of a fracturing operation. In the illustrated embodiment, the tree 16C includes actuated valves 50 while the remaining trees 16A, 16B, and 16D include manually operated valves. As such, operations can be performed on the tree 16C using the same actuators utilized for operations with the tree 16A and the tree 16B, thereby decreasing the cost of operations at the well site.

Figure 7:
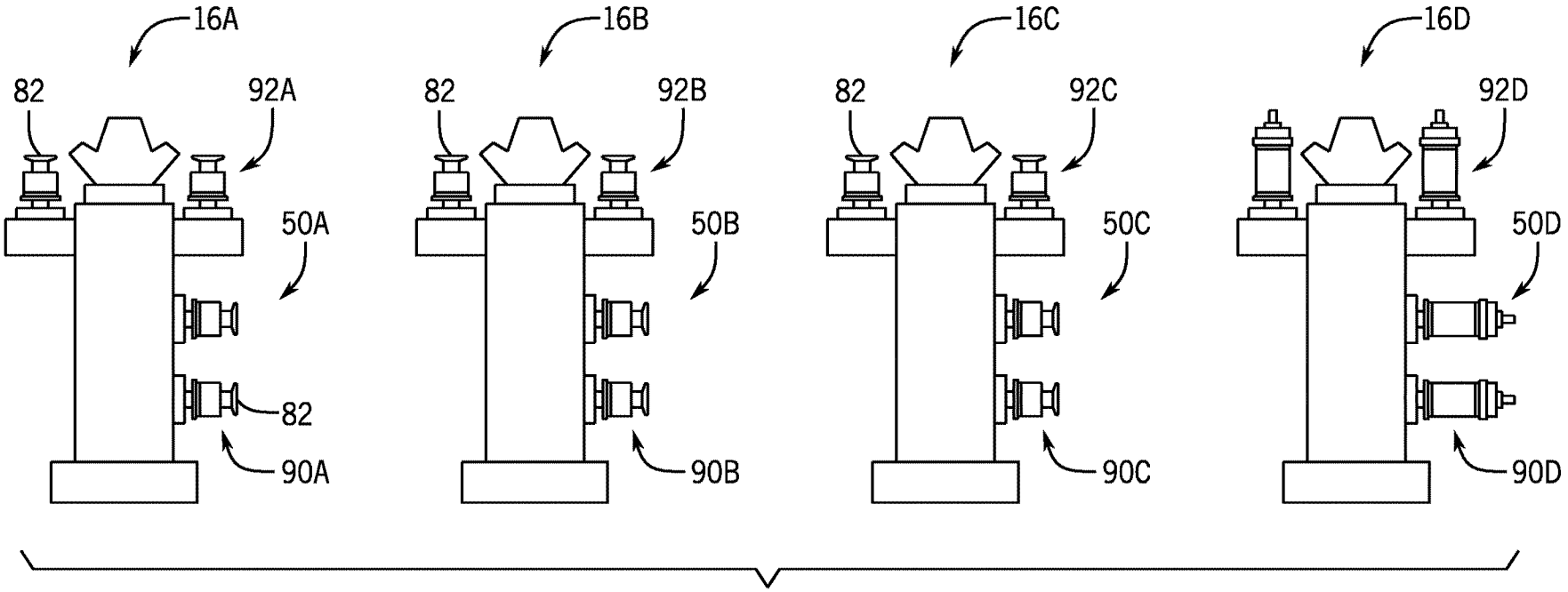
FIG. 7 is a schematic side view of an embodiment of a fracturing operation including four trees, in accordance with embodiments of the present disclosure.

FIG. 7 is a schematic diagram of the trees 16A-D during stage four of a fracturing operation. In the illustrated embodiment, the tree 16D includes actuated valves 50 while the remaining trees 16A-C include manually operated valves. As such, operations can be performed on the tree 16D using the same actuators utilized for operations with the trees 16A-C, thereby decreasing the cost of operations at the well site. Moreover, as described above, in certain embodiments the removable operator 52 may be utilized to switch out the actuator and the manual operators, thereby enabling quick change outs to reduce down time at the well site.

Performing operations in the manner described above significantly reduces the cost of the equipment to perform the operations. In embodiments where the actuated valves are hydraulically actuated valves, hydraulic systems (which may include a generator, pumps, and accumulator for each system, as well as the actuators) may not be used for each tree and therefore a single hydraulic system may be used to perform operations on the four trees. Using a single system both reduces costs and non-productive time for the equipment. Utilizing the quick disconnecting features of the equipment also maintains the time efficiency of the operations, therefore decreasing costs while maintaining or improving production downtime. Additionally, this method of operations is flexible where any combination of hydraulic and operator systems to decrease conversion time and improve efficiency may be used.

Figure 8:
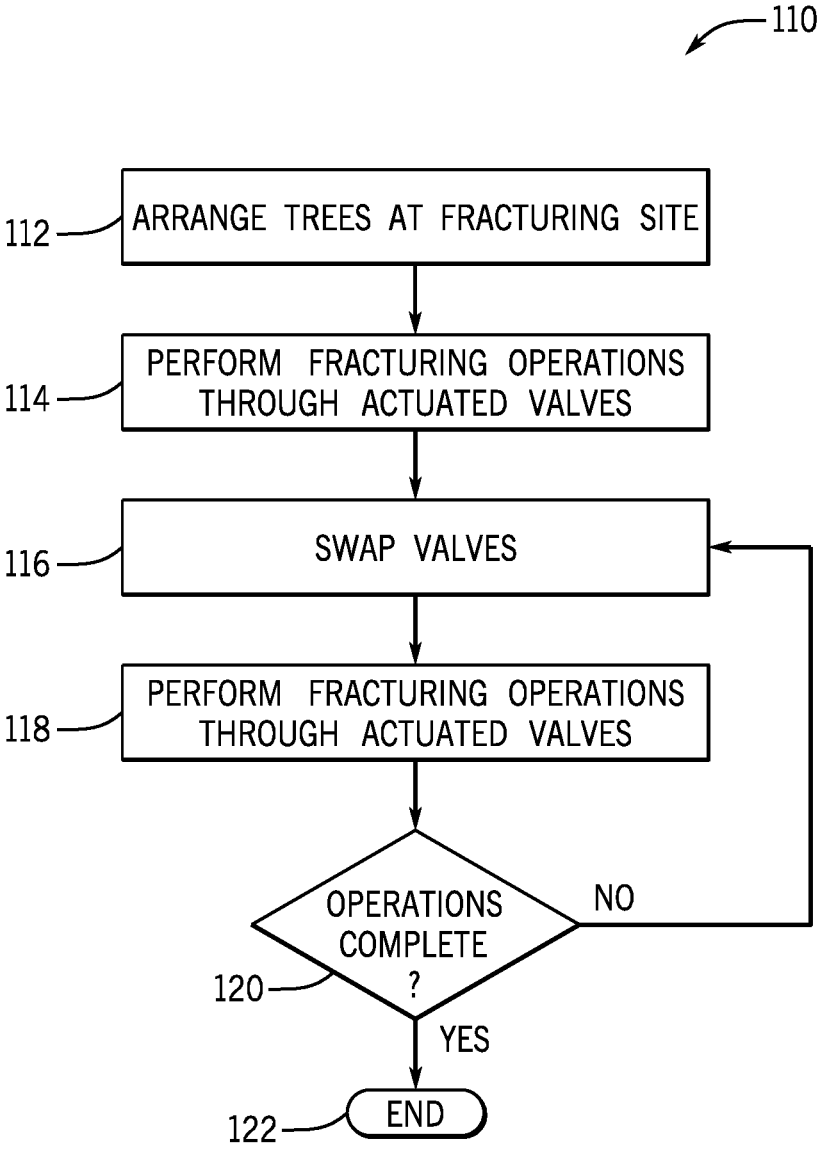
FIG. 8 is a flow chart of an embodiment of a method for performing fracturing operations at a well site, in accordance with embodiments of the present disclosure.

FIG. 8 is a method 110 for performing a hydraulic fracturing operation. It should be appreciated that the method 110 may include additional steps and that the steps may be performed in a different order or in parallel, unless otherwise specified. The method 110 begins with a plurality of trees 16 arranged at a fracturing site (block 112). These trees 16 may include one or more valves 50, as described above, and the valves may be manually operated or actuated. In various embodiments, at least one tree 16 of the plurality of trees 16 includes actuators while at least one tree of the plurality of trees 16 includes valves 50 that are manually operated. Fracturing operations may be performed through at least one tree 16 of the plurality of trees 16 (block 114). In various embodiments, fracturing operations are performed through the tree 16 that includes the actuators, as the valves 50 may be cycled multiple times during fracturing operations. Then, the operation methods for the trees 16 are switched (block 116). As used herein, to switch the operation methods refers to replacing actuators for manual operators and vice-versa. For example, once fracturing operations are complete, the actuators may be removed from the tree 16 that initially included the actuators, placed on a tree 16 that will undergo fracturing operations next, and manual operators may be placed on the tree 16 that recently completed fracturing operations. In this manner, the actuators can be used in areas where they will provide high value to operators (e.g., fracturing operations) but not in situations where they provide lower value to operators (e.g., on a tree 16 that is not in operation).

After the valves have been swapped, fracturing operations may commence through the tree 16 that has acquired the actuators (block 118). Upon complete of the fracturing operations through the tree 16, the remaining trees 16 may be checked to determine whether fracturing operations are complete (operator 120). If they are, the method may end 112. If not, the operation methods may be swapped to a different tree 16 for further fracturing operations (124).

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A method for conducting hydraulic fracturing operations, the method comprising:

positioning a plurality of fracturing trees at a well site, the well site associated with the hydraulic fracturing operations;

including a first valve on a first fracturing tree of the plurality of fracturing trees, the first valve being coupled to an actuator to control operation of the first valve and the actuator being operated remotely by an operator that is not within a predetermined proximity of the first fracturing tree;

performing the hydraulic fracturing operations through the first tree;

removing the actuator from the first valve after the hydraulic fracturing operations through the first tree are complete;

installing the actuator on a second valve on a second fracturing tree of the plurality of trees; and performing the hydraulic fracturing operations through the second tree.

2. The method of claim 1, further comprising:

installing a manual operator on the first valve after the actuator is removed.

3. The method of claim 2, wherein the manual operator comprises a hand wheel.

4. The method of claim 2, wherein the first valve includes a quick connection bonnet enabling removal of the actuator without removing a valve stem of the first valve.

5. The method of claim 2, wherein the first valve comprises a rotary to linear converter, the rotary to linear converter transforming rotational movement of the manual operator into linear movement for driving a valve stem of the first valve.

6. The method of claim 1, further comprising:

removing the actuator from the second valve after the hydraulic fracturing operations through the second tree are complete; and installing the actuator on a third valve on a third fracturing tree of the plurality of trees.

7. The method of claim 1, wherein the actuator comprise a hydraulic actuator, a pneumatic actuator, an electric actuator, or a combination thereof.

8. The method of claim 1, further comprising:

positioning a secondary system for operating the actuator at the well site;

coupling the secondary system to the actuator on the first valve;

decoupling the secondary system from the actuator before the actuator is removed from the first valve; and coupling the secondary system to the actuator on the second valve after the actuator is installed on the second valve.

9. The method of claim 1, wherein the plurality of fracturing trees are arranged within a predetermined proximity of one another, the predetermined proximity being within a distance such that personnel cannot operate adjacent fracturing trees of the plurality of fracturing trees during the hydraulic fracturing operations through one of the fracturing trees of the plurality of fracturing trees due to regulations or procedures.

10. A method of replacing valve operation methods, the method comprising:

installing a first operator on a first valve of a first fracturing tree, the first operator being an actuator that controls operation of the first valve;

installing a second operator on a second valve of a second fracturing tree, the second fracturing tree being adjacent the first fracturing tree, and the second operator being a manual operator that is controlled by physical control with the manual operator;

performing a first hydraulic fracturing operation using the first fracturing tree;

completing the first hydraulic fracturing operation using the first fracturing tree;

removing the first operator from the first valve, the first valve maintaining a position on the first fracturing tree after the first operator is removed;

removing the second operator from the second valve, the second valve maintaining a position on the second fracturing tree after the second operator is removed; and installing the first operator on the second valve after the first operator is removed from the first valve and after the second operator is removed from the second valve.

11. The method of claim 10, further comprising:

installing the second operator on the first valve after the first operator is removed from the first valve.

12. The method of claim 10, further comprising:

performing a second hydraulic fracturing operation using the second fracturing tree;

completing a second hydraulic fracturing operation using the second fracturing tree;

removing the first operator from the second valve, the second valve maintaining a position on the second fracturing tree after the first operator is removed.

13. The method of claim 10, wherein the first valve comprises a rotary to linear converter, the rotary to linear converter transforming rotational movement of the first operator into linear movement for driving a valve stem of the first valve.

14. The method of claim 10, where the first and second valves include respective quick connection bonnets enabling removal of the first and second operators without removing respective valve stems of the first and second valves.

15. The method of claim 10, wherein the first operator comprises a hydraulic operator, a pneumatic operator, an electric operator, or a combination thereof.

16. A method for performing hydraulic fracturing operations, the method comprising:

positioning a first fracturing tree at a well site, the first fracturing tree including a first valve controlling a first flow through the first fracturing tree;

positioning a second fracturing tree at the well site, the second fracturing tree including a second valve controlling a second flow through the second fracturing tree, the second fracturing tree being positioned adjacent the first fracturing tree such that access to the second fracturing tree is restricted while the first fracturing tree is in use;

performing the hydraulic fracturing operations through the first fracturing tree;

removing a first operator from the first valve, the first valve maintaining a position on the first fracturing tree after the first operator is removed, and the first operator being an actuator;

removing a second operator from the second valve, the second valve maintaining a position on the second fracturing tree after the second operator is removed, and the second operator being a manual operator;

installing the first operator on the second valve after the first operator is removed from the first valve and after the second operator is removed from the second valve; and performing the hydraulic fracturing operations through the second fracturing tree.

17. The method of claim 16, wherein the first operator comprises a hydraulic operator, a pneumatic operator, an electric operator, or a combination thereof.

18. The method of claim 16, where the first and second valves include respective quick connection bonnets enabling removal of the first and second operators without removing respective valve stems of the first and second valves.

19. The method of claim 16, further comprising:

removing the first operator from the second valve; and installing the first operator on the third valve on a third fracturing tree, the third fracturing tree being adjacent the first and second hydraulic fracturing trees.

20. The method of claim 16, wherein the manual operator comprises a hand wheel.

* * * * *